US007506852B1

(12) United States Patent
Towfigh et al.

(10) Patent No.: US 7,506,852 B1
(45) Date of Patent: Mar. 24, 2009

(54) SHELVING SUPPORT BRACKET

(75) Inventors: Keivan Towfigh, West Medford, MA (US); David A. Greenberg, Winchester, MA (US)

(73) Assignee: Rangine Corporation, Needham, MA (US)

( * ) Notice: Subject to any disclaimer, the term of this patent is extended or adjusted under 35 U.S.C. 154(b) by 79 days.

(21) Appl. No.: 11/544,226

(22) Filed: Oct. 6, 2006

(51) Int. Cl.
*A47G 29/02* (2006.01)

(52) U.S. Cl. ..... 248/243; 248/235; 108/151

(58) Field of Classification Search ..... 248/243, 248/235, 250, 216.4, 219.3, 223.41, 238, 248/218.4, 219.1, 219.4, 227.3, 227.4; 108/151, 108/152; 182/187, 188; 211/103, 107
See application file for complete search history.

(56) References Cited

U.S. PATENT DOCUMENTS 625,271 A * 5/1899 Lang ..... 211/85.13
3,343,685 A * 9/1967 Giambalvo ..... 211/187
3,771,466 A * 11/1973 Ferdinand et al. ..... 108/109
3,865,337 A 2/1975 Towfigh et al.
3,920,295 A * 11/1975 Speckin ..... 312/108
4,730,802 A * 3/1988 Chatham et al. ..... 248/238
4,865,283 A * 9/1989 Parker ..... 248/159
5,996,511 A * 12/1999 Swoger ..... 108/157.13
6,796,249 B1 * 9/2004 Hiras ..... 108/157.13

* cited by examiner

*Primary Examiner*—Anita M King
(74) *Attorney, Agent, or Firm*—K&L Gates LLP

(57) ABSTRACT

A shelving bracket for supporting an end of a shelf is adapted to be attachable at any location along the length of a height-wise extending pole. The bracket is adapted to bear against a side face of a pole and includes at least two guide surfaces engageable with front and rear faces of the pole to define the angle of orientation of the bracket and to maintain the bracket at that angle. The bracket is secured rigidly to the pole by a fastener. A second pole is provided with a similar shelf bracket. Each of the shelf brackets has a shelf-supporting ledge adapted to support an end of a shelf that spans between the poles.

15 Claims, 8 Drawing Sheets

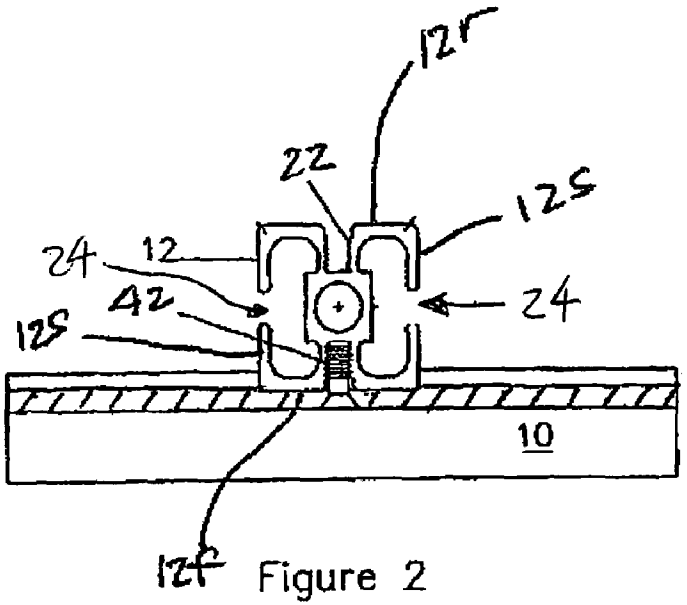
Figure 2
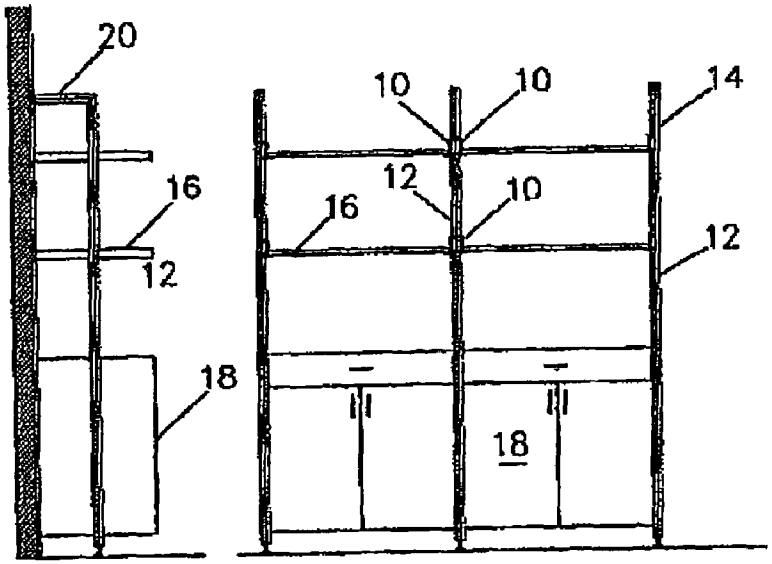
FIGURE 1A
FIGURE 1B

SHELVING SUPPORT BRACKET

FIELD OF THE INVENTION

This invention relates to shelving support brackets for supporting shelves at their ends.

BACKGROUND AND SUMMARY OF THE INVENTION

This invention relates to a shelving support bracket for use with shelving systems having vertically oriented support poles to which the brackets are mounted for heightwise adjustment. The bracket is adapted to be clamped directly against a face of the support pole and has a ledge adapted to a support one end of a shelf. The other end of the shelf is supported on a ledge of a similar bracket that is secured to another support pole, such that the shelf is supported between and spans the pair of support poles. The bracket includes guide surfaces that engage and embrace the pole to define the angle that the supported shelf will make with the vertical and to prevent relative rotation of the bracket with respect to the pole. In a preferred embodiment of the invention the pole is provided with a longitudinally extending channel to which a fastening member can be secured at any heightwise location along the pole. The bracket includes an aperture receptive to the fastening member to enable the bracket to be secured to the pole. The channel may be provided with longitudinally extending threads and the fastening member may be in the form of a machine bolt.

DESCRIPTION OF THE DRAWINGS

FIG. 1A is a front elevation of a shelving system embodying features of the invention;

FIG. 1B is a side elevation of the shelving system of FIG. 1A;

FIG. 2 is a plan view, partly in section, of a pole with a bracket attached;

DESCRIPTION OF THE ILLUSTRATIVE EMBODIMENTS

Figures 3, 4:
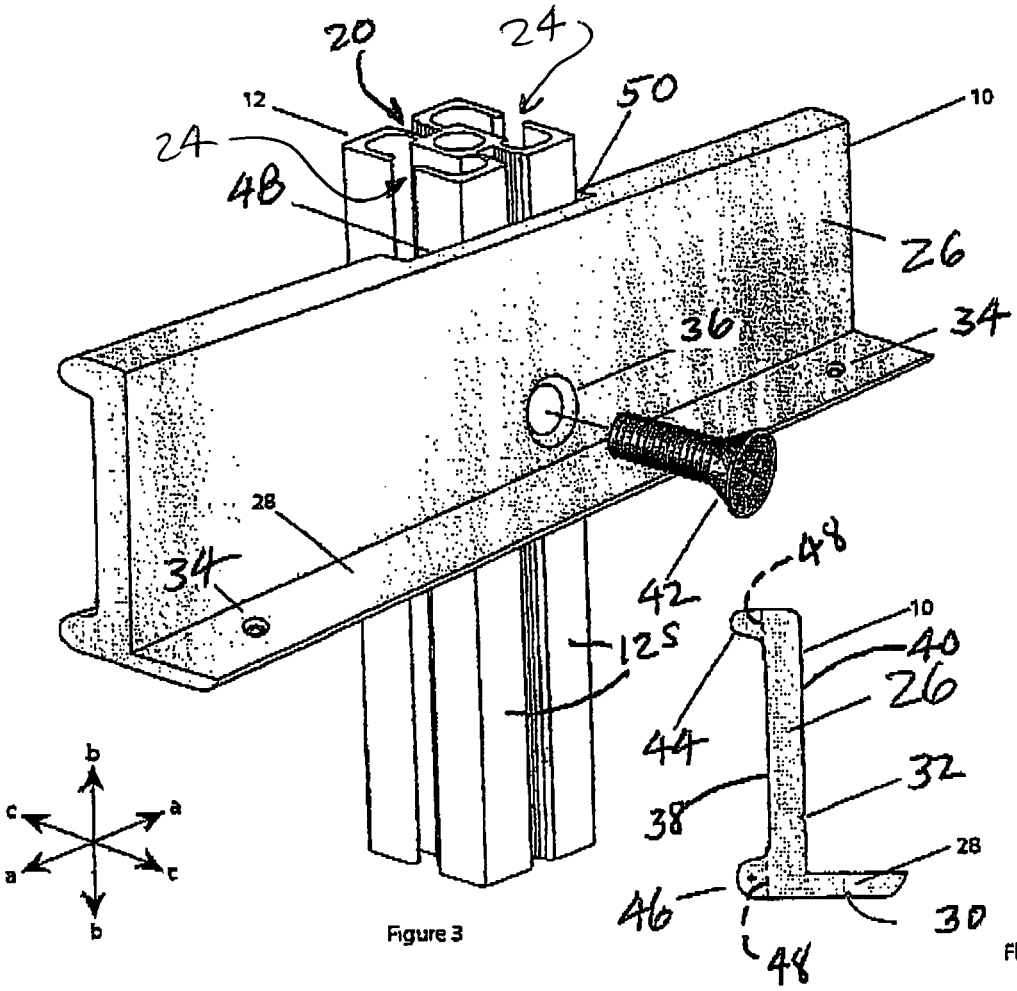
FIG. 3 is a perspective view, partly exploded, of the pole and bracket of FIG. 2.
FIG. 4 is a sectional illustration of the bracket.
Figure 5A:
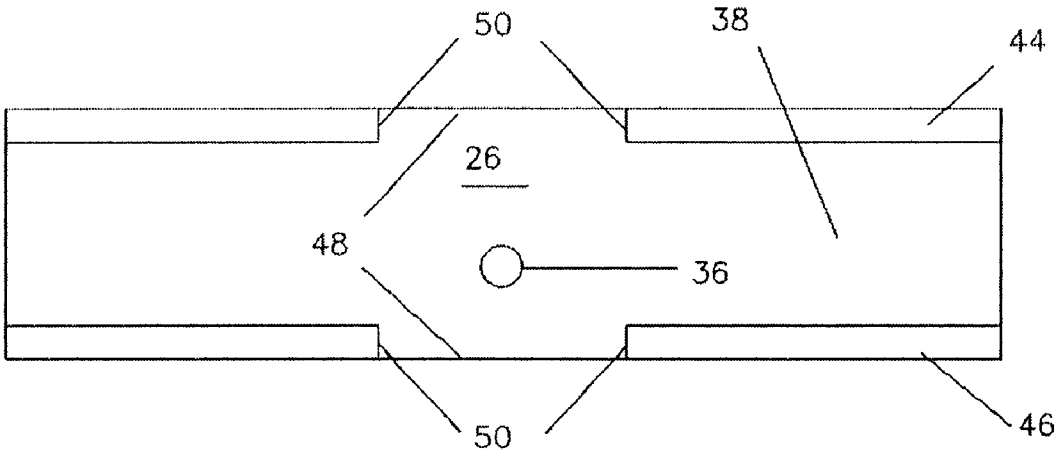
FIG. 5A is an elevation of the pole-engaging face off the bracket.
Figure 5B:
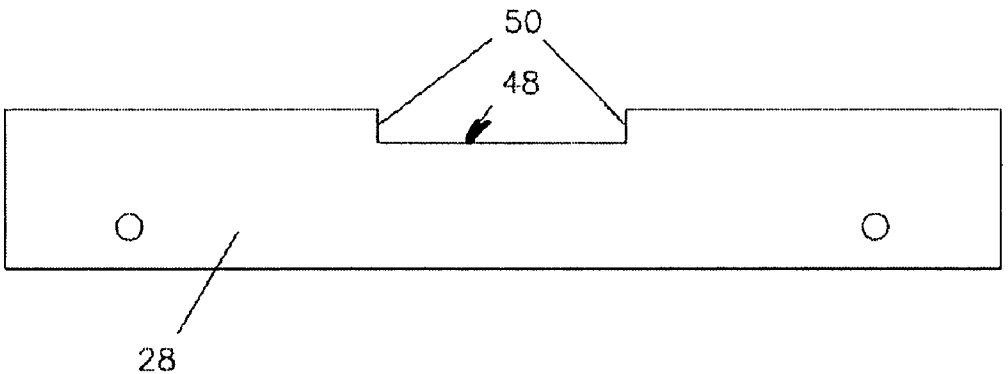
FIG. 5B is an illustration of the bracket viewed from its underside.

FIGS. 1A and 1B show a shelving system 14 having a plurality of upright poles 12 and shelf brackets 10 attached to the poles 12. Shelves 16 are supported, at their ends, by brackets 10. The shelving system 14 may include one or more cabinets 18 that may be secured directly to the upright poles

12. The lower ends of the poles 12 rest on the floor and their upper ends may be securely engaged with the ceiling or to the wall, as by way of a return arm 20. The poles 12 may be of a type commercially available from Rangine Corporation of Needham, Mass., formed from extruded aluminum, and of generally rectangular or square cross-section. Each pole 12 may be considered as having a front face 12*f*, a rear face 12*r* and side faces 12*s*. The side faces of the pole 12*s* are, in a preferred embodiment, formed with longitudinally extending channels 20 that include longitudinally extending threads 22 adapted to be engaged with machine bolts or the like. The front and rear faces 12*f*, 12*r* of the pole 12 may include channels 24 designed to accept a cantilevered bracket of the type described in U.S. Pat. No. 3,865,337, although those are not a part of the present invention.

For ease of description a direction toward the front of the shelving system will be referred to as "forward" and a reverse direction (i.e., toward the wall) will be referred to as "rearward." The side faces of poles that support brackets that cooperate to support the ends of a shelf are attached are referred to as facing inwardly."

FIGS. 2-5 illustrate one form of the bracket. The bracket 10 has an elongate rigid body and is generally L-shaped in cross-section (FIG. 4), having an upright wall 26 and a flange 28 extending inwardly from the lower portion of the wall 26. The flange is adapted to provide support for one end of a shelf 16, the other end of the shelf being supported by a similar bracket, mounted on the next adjacent pole 12. The bracket 10 may be extruded to include recessed scribe lines 30, 32, one of which 30 may serve to facilitate placement of holes 34 adapted to receive screws by which an end of a shelf can be secured to the flange and the other of which 32 may serve to locate a mounting aperture 36 on the bracket wall 26.

The web portion extends along the first axis a-a and along a second axis b-b oriented perpendicular to the first axis. The thickness of the web portion is measured along a third axis c-c, perpendicular to the first and the second axes. The shelf portion extends along the first and third axes. The web portion typically is flat and planar, as is the shelf portion, as illustrated. The first and third axes normally extend horizontally, and the second axis vertically, as shown. The upright wall 26 of the bracket 10 may be considered as having a pole-engaging face 38 and a shelf-engaging face 40, the flange 28 projecting from the latter. The pole-engaging face is adapted to bear against a side face 12*s* of the pole with the bracket 10 being secured to the pole by a fastener member, such as a threaded screw 42 adapted to engage securely the threaded channel 20 extending along a side face 12*s* of the pole. In a preferred embodiment, the aperture 36 is positioned closer to the bottom of the wall 26 than the top so that when a shelf 16 is supported on the ledge 28, the shelf will cover the screw head. Preferably, the screw has a flat head and the aperture 36 is correspondingly countersunk to present a flush surface. Other types of suitable features may be used.

In order to prevent the bracket 10 from rotating with respect to the pole 12 about the axis of the fastener 42, the bracket is provided with additional pole-engaging means that may take any of a number of forms. In the embodiment illustrated in FIGS. 3 and 4, the bracket 10 is provided with a pair of ribs 44, 46 extending from the pole-engaging side 38 of the bracket wall 26, the ribs being spaced heightwise of each other. Each of the ribs is provided with a notch 48 that defines a pair of spaced shoulders 50. The notch 48 and shoulders 50 are dimensioned so that when the pole-engaging face 38 is engaged with its associated side face 12*s* of the pole 12, a portion of the pole will be received within the notch 48 and will be embraced in close engagement by the shoulders 50.

With a shelf bracket 10 securely fastened in this manner to the pole 12, its position and orientation on the pole is fixed and rigid. Thus, it may be appreciated that with this embodiment, the four pole-engaging shoulders 50 and the threaded fastener 42 cooperate to define four triangularly arranged points of engagement, with the fastener defining a common apex, between the pole and the bracket.

The bracket 10 is a one-piece, unitary structure, preferably formed by extrusion, from a range of extrudable materials including metals such as aluminum. Other fabrication techniques, such as molding, also may be employed.

In a preferred embodiment, in which the pole is provided with channels having longitudinally extending threads 22, the bracket is secured to the pole by a threaded fastener, such as a machine screw. To that end, the main wall of the bracket includes an aperture to receive the machine screw.

Figure 6:
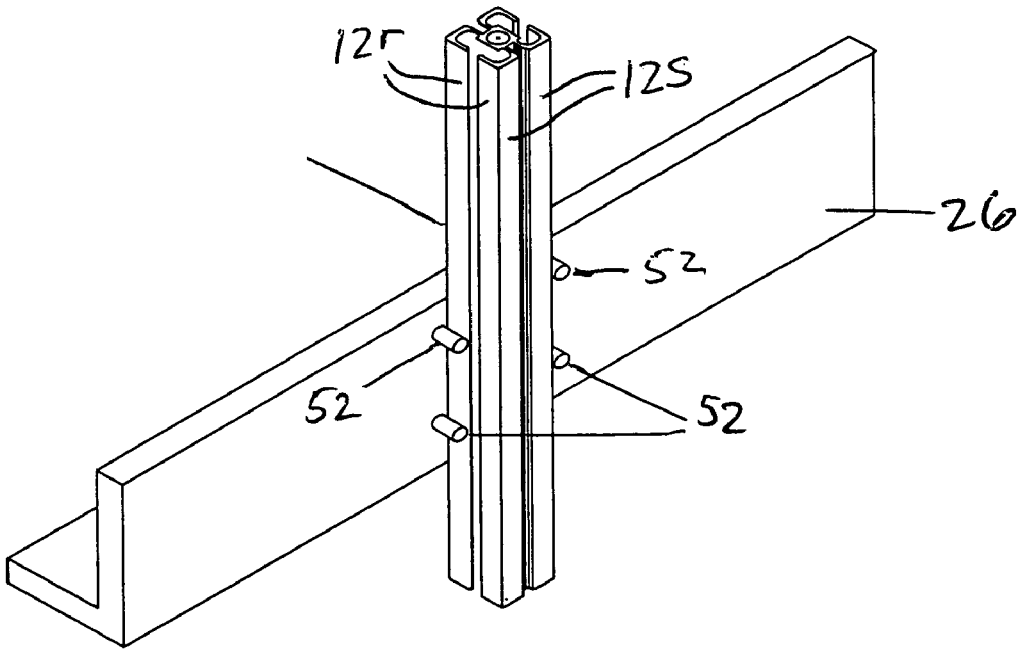
FIG. 6 is an illustration of another embodiment of the invention.

FIG. 6 illustrates another embodiment in which the arrangement for guiding, orienting and retaining the bracket relative to the pole is defined by surfaces of a plurality of pins 52 or other projections protruding from the pole-engaging face of the bracket. With this arrangement, the ribs 44, 46 may be omitted. The pins 52 may be press-fitted or otherwise secured to the pole-engaging face 38 of the bracket. The arrangement shown in FIG. 6 may be modified to include only a single pair of pins 52 adapted to engage the front and rear faces of the pole. The pins 52 should be aligned with each other to define at least one isosceles triangle between the pins and the bolt.

Figure 7:
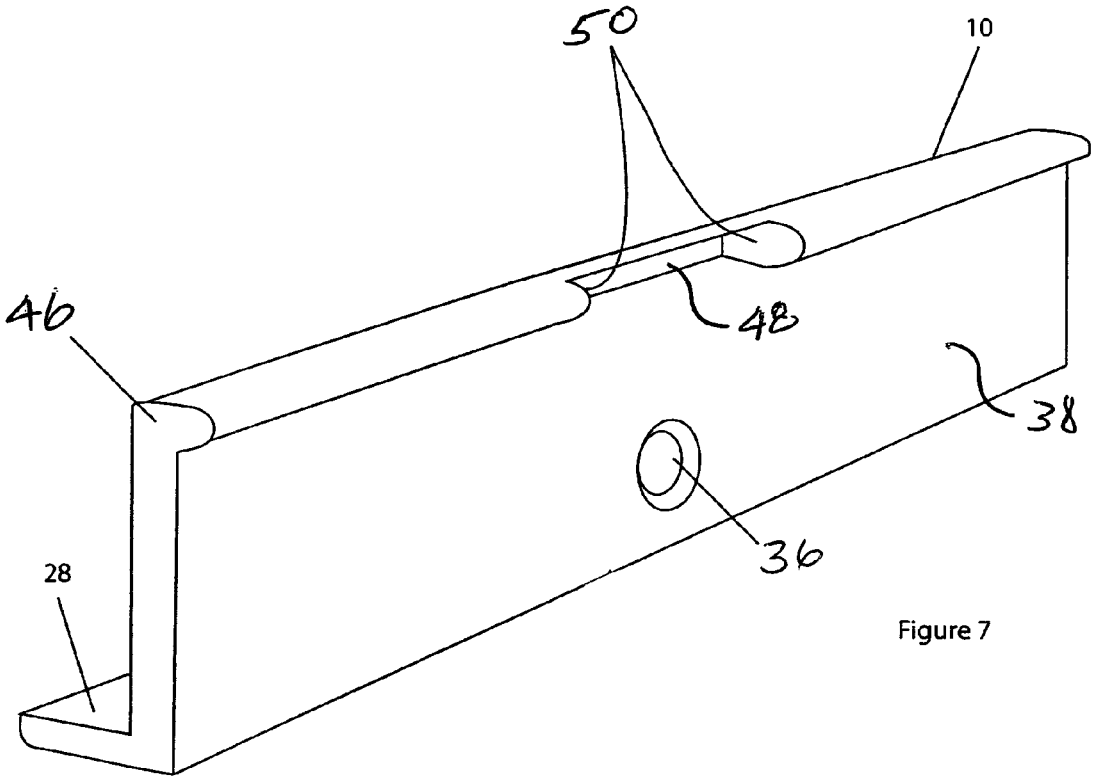
FIG. 7 is an illustration of another embodiment of the invention.

FIG. 7 illustrates a modified form of the bracket in which the lower rib is omitted. In this embodiment, a single rib, at the upper region of the bracket is employed.

Figure 8A:
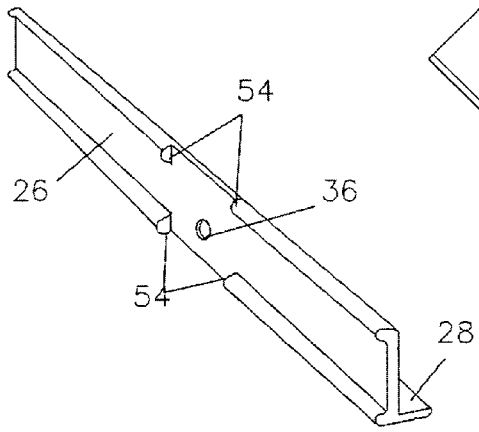
FIG. 8A is an illustration of the another embodiment of bracket range to support a shelf at an incline.
Figure 8B:
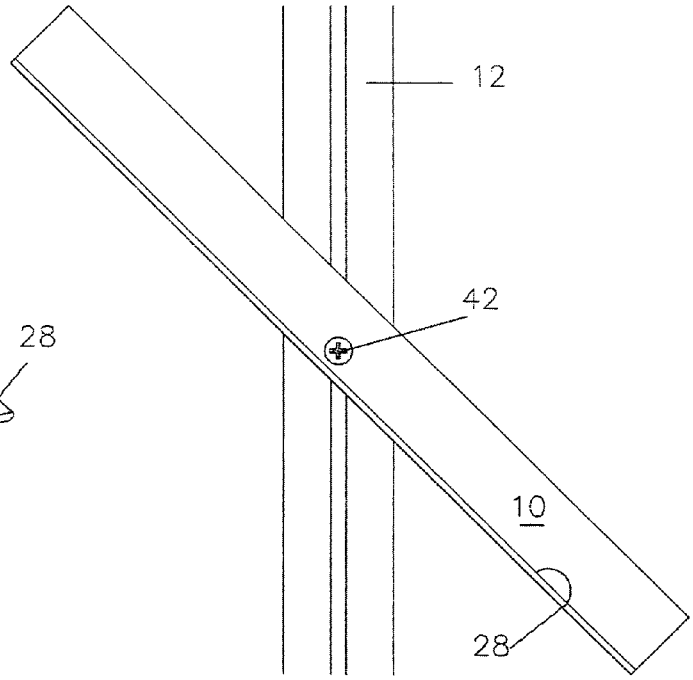
FIG. 8B is a side elevation of the bracket of FIG. 8A secured to an upright pole.

FIGS. 8A and 8B illustrate a variation of the invention in which it is desired to mount a shelf 16 at an incline. To that end, the bracket 10 is formed with guiding surfaces, such as shoulders, pins or a channel defined by a notch, or otherwise, adapted to engage the pole so that the bracket is not perpendicular to the pole. By way of illustration, brackets such as that illustrated in FIGS. 3 and 4 may be modified to provide the shoulders 54 to align along parallel lines that lie at an angle other than perpendicular to the longitudinal axis of the bracket. Thus, when the bracket 10 is fitted to the pole 12, the shoulders (or channel wall or pins or the like) will serve as a guide to assure the desired angled orientation of the bracket with respect to the pole. It should be noted in this embodiment that the relationship between the fastening screw and the screws still defines one or more triangles.

Figure 9:
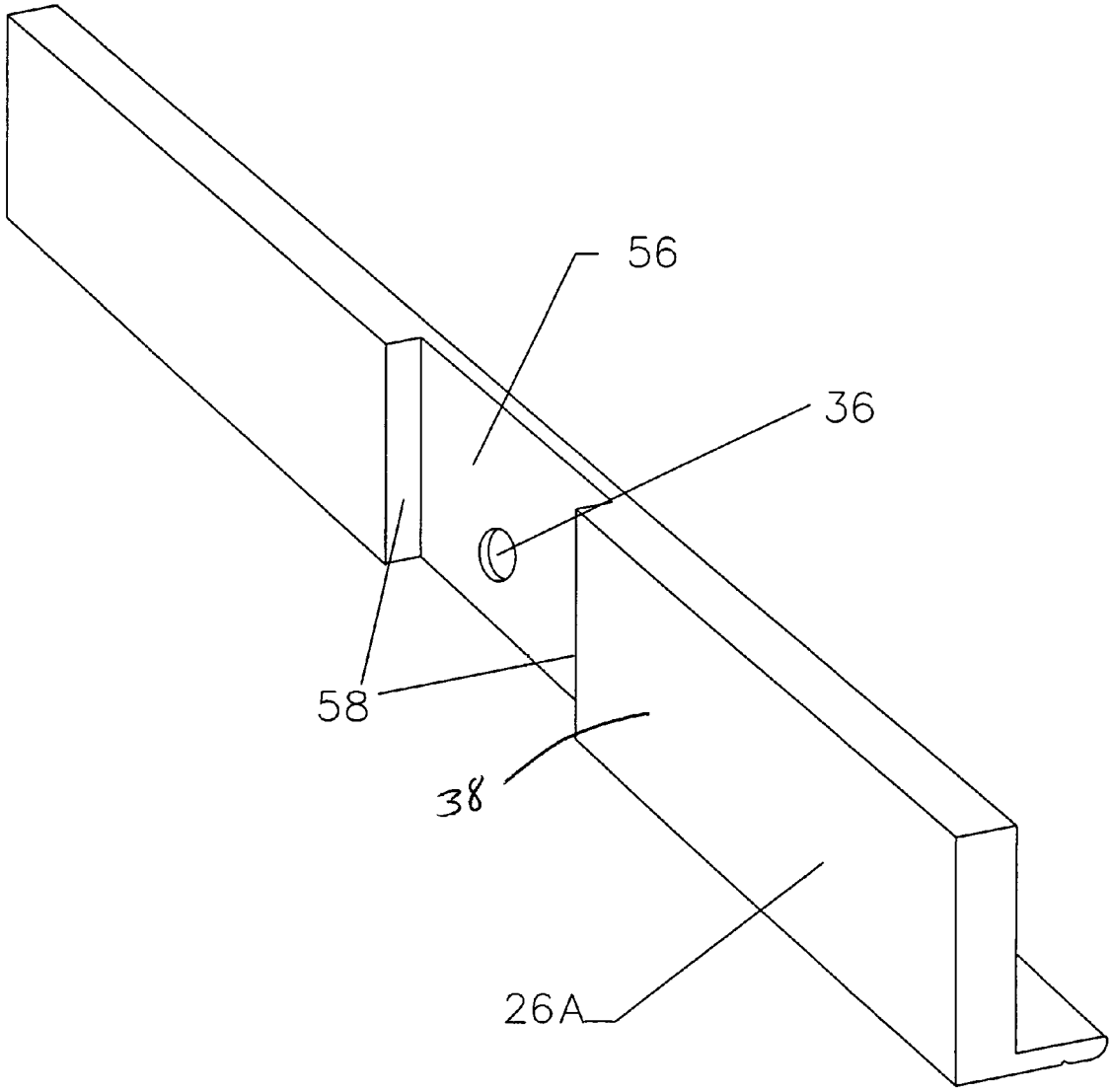
FIG. 9 is an illustration of another variation of the invention.

FIG. 9 shows a further embodiment of the invention in which the bracket wall 26A is of increased thickness sufficient to enable a channel 56 to be formed along the full height of the wall 26A on the pole-engaging face 38 of the bracket. The width of the channel is dimensioned with respect to the post to receive the post in snug engagement sufficiently to prevent relative rotation of the bracket with respect to the pole when the two are secured together. The channel includes sidewalls 58 that embrace the front and rear faces of the pole to prevent relative rotation.

Figure 10:
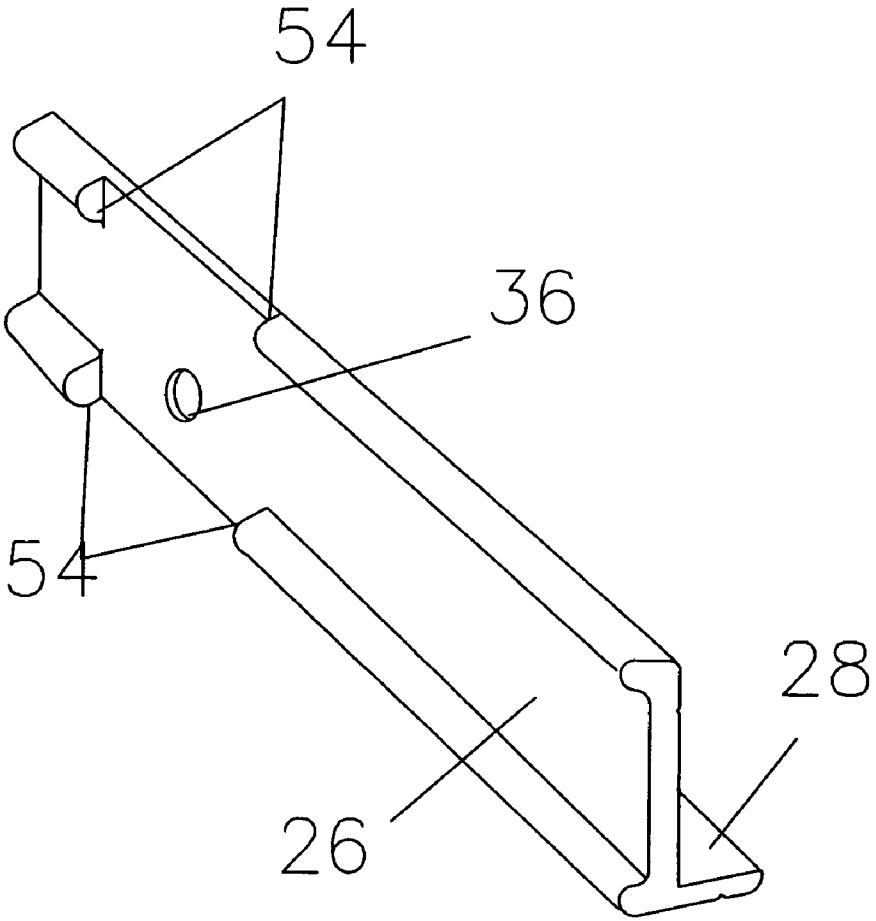
FIG. 10 is an illustration of a bracket configured for cantilevered mountings.

FIG. 10 illustrates a modified embodiment in which the guide surfaces (e.g., shoulders, pins) are located closer to one end of the bracket than to the other. This enables a bracket to be mounted in a cantilevered fashion.

The invention claimed is:

1. A shelving bracket for supporting an end of a shelf, the bracket being adapted to be mounted to a heightwise extending pole having side, front and rear faces, and a channel extending longitudinally of the pole and on the side face, the bracket comprising:

an elongate rigid body having a pole-facing surface adapted to bear against a side face of a pole and a shelf-facing surface on the opposite side of the body, the body having a shelf support extending from the shelf-facing surface and adapted to support the end of a shelf, at least two guide surfaces extending from the pole-facing surface, the guide surfaces being spaced to engage the front and rear faces of the pole when the pole-facing surface of the bracket bears against a side face of the pole, the guide surfaces being configured to define the angle of orientation of the bracket with respect to the pole and to maintain the bracket at that angle;

a fastener for securing the bracket in that orientation to the pole;

the fastener being engageable with the channel;

the bracket having an aperture to enable the fastener to extend therethrough.

2. A shelving bracket as defined in claim 1 further comprising the combination of the pole and the bracket and wherein the pole channel has longitudinally extending threads and the fastener is threaded for engagement with the threads in the pole channel.

3. A shelving bracket as defined in claim 1 further comprising:

the aperture located on the body of the bracket in close proximity to the shelf support whereby when the shelf is supported by the shelf support the end of the shelf will conceal the fastener.

4. A shelving bracket as defined in claim 1 further comprising:

at least one rib extending from the pole-engaging face of the bracket, the rib having a notch formed therein that is receptive to a portion of the pole, the notch defining shoulders engageable with the front and rear faces of the pole and comprising said guide surfaces.

5. A shelving bracket as defined in claim 4 wherein the bracket has a pair of ribs, each with a notch and each defining a pair of pole-engaging shoulders.

6. A shelving bracket as defined in claim 1 wherein the guide surfaces are defined by a plurality of members that project from the pole-engaging face, the members being spaced to snugly embrace the pole.

7. A shelving bracket as defined in claim 1 wherein the guide surfaces are located to orient the bracket at an angle that is non-perpendicular to the pole.

8. A shelving bracket as defined in claim 1 wherein the body has a continuous channel formed along the pole-engaging surface to define a pair of sidewalls engageable with the front and rear faces of the pole while the face of the channel engages the side face of the pole.

9. A shelving bracket as defined in claim 1 wherein the guide surfaces are located centrally along the length of the bracket.

10. A shelving bracket as defined in claim 1 wherein the guide surfaces are located closer to one end of the body than to the other whereby the bracket may be secured to the pole in a cantilevered configuration.

11. A shelving bracket for supporting an end of a shelf, the bracket being adapted to be mounted to a heightwise extending pole having side, front and rear faces, the bracket comprising:

an elongate rigid body having a pole-facing surface adapted to bear against a side face of the pole and a shelf-facing surface on the opposite side of the body, the body having a shelf support extending from the shelf-facing surface and adapted to support the end of the shelf;

at least two guide surfaces extending from the pole-facing surface, the guide surfaces being spaced to enable the pole to be mated with the bracket at any location along the length of the pole and with the guide surfaces in engagement with the front and rear faces of the pole when the pole-facing surface of the bracket bears against a side face of the pole, the guide surfaces being configured to define the angle of orientation of the bracket with respect to the pole and to maintain the bracket at that angle;

a fastener for rigidly securing the bracket in that orientation to the pole;

at least one rib extending from the pole-engaging face of the bracket, the rib having a notch formed therein that is receptive to a portion of the pole, the notch defining shoulders engageable with the front and rear faces of the pole and comprising said guide surfaces; and wherein the shoulders and the fastener define a triangular configuration.

12. A shelving bracket as defined in claim 11 wherein the fastener is substantially equidistant from each of the shoulders.

13. A shelving system for supporting shelves between a pair of heightwise extending poles, the system comprising:

at least two heightwise extending poles, each having side, front and rear faces;

at least one bracket mounted to each pole, each bracket comprising an elongate rigid body having a pole-facing surface adapted to bear against a side face of a pole and a shelf-facing surface on the opposite side of the body, the body having a shelf support extending from the shelf-facing surface and adapted to support the end of a shelf;

each bracket having at least two guide surfaces extending from the pole-facing surface, the guide surfaces being spaced to receive its associated pole at any location along the length of the pole and to engage the front and rear faces of the pole when the pole-facing surface of the bracket bears against a side face of the pole, the guide surfaces being configured to define the angle of orientation of the bracket with respect to the pole and to maintain the bracket at that angle;

a fastener rigidly securing the bracket in that orientation to the pole;

the brackets being mounted to the poles with their shelf-facing surfaces and shelf supports facing each other; and wherein each of the brackets has an aperture to enable the fastener to extend therethrough;

whereby a shelf may be supported, at its opposite ends, by the shelf support.

14. A shelving system as defined in claim 13 further comprising:

each pole having a channel extending longitudinally of the pole and on a side face, the fastener being constructed to engage with the channel to secure the bracket to the pole.

15. A shelving system as defined in claim 13 wherein the guide surfaces are defined by a plurality of members that project from the pole-engaging face, the members being spaced to snugly embrace the pole.

* * * * *